US005139149A

United States Patent [19]

Gerlier

[11] Patent Number: 5,139,149

[45] Date of Patent: Aug. 18, 1992

[54] APPARATUS FOR STACKING SHEETS

[75] Inventor: André Gerlier, Sciez, France

[73] Assignee: Landis & Gyr Betriebs AG, Zug, Switzerland

[21] Appl. No.: 732,045

[22] Filed: Jul. 18, 1991

[30] Foreign Application Priority Data

Aug. 6, 1990 [CH] Switzerland ..... 2566/90

[51] Int. Cl.[5] ..... B07C 5/00

[52] U.S. Cl. ..... 209/534; 209/552; 209/900; 271/212

[58] Field of Search ..... 209/534, 552, 583, 584, 209/900; 271/65, 180, 186, 212; 414/794.4

[56] References Cited

U.S. PATENT DOCUMENTS

| | | | |
|---|---|---|---|
| 4,540,081 | 9/1985 | Mori et al. | 209/534 X |
| 4,693,464 | 9/1987 | Honma | 271/65 X |
| 4,697,071 | 9/1987 | Hiraoka et al. | 209/534 X |
| 4,804,175 | 2/1989 | Grandjean | 271/225 |
| 4,807,866 | 2/1989 | Stemmle | 271/212 X |
| 4,830,351 | 5/1989 | Stanislaw | 270/31 |
| 4,830,742 | 5/1989 | Takesako | 209/534 |
| 4,842,263 | 6/1989 | Robertson | 271/65 X |

FOREIGN PATENT DOCUMENTS

| | | | |
|---|---|---|---|
| 0072237 | 2/1983 | European Pat. Off. . | |
| 9005298 | 10/1990 | Fed. Rep. of Germany . | |
| 2593485 | 7/1987 | France . | |
| 257733 | 11/1969 | U.S.S.R. | 271/212 |
| 1510934 | 5/1978 | United Kingdom . | |
| 1542355 | 3/1979 | United Kingdom . | |
| 2130414 | 5/1984 | United Kingdom . | |
| 2161145 | 1/1986 | United Kingdom . | |
| 2168689 | 6/1986 | United Kingdom . | |
| 2198122 | 6/1988 | United Kingdom . | |

OTHER PUBLICATIONS

"Bill Arrangement Mechanism for Bill-Handling Machine," K. Satoh, IBM Tech. Disclosure Bulletin, vol. 26, No. 9, Feb. 1984, pp. 4580–4581.

*Primary Examiner*—Donald T. Hajec
*Assistant Examiner*—Joseph A. Kaufman
*Attorney, Agent, or Firm*—Marmorek, Guttman & Rubenstein

[57] ABSTRACT

An apparatus for stacking sheets comprises a belt of predetermined length and an endless belt. The belts pass around fixed axis rollers and three guide rollers which are displaceable for the purpose of varying the belt geometry by means of a carriage. As soon as a sheet passes in one direction of movement into a transportation plane formed by the belts a drive displaces the carriage on a rail into a position above a stack in the same direction of movement, the sheet which is engaged by the belts being conveyed at double the speed of the carriage to one of the guide rollers around which it is rolled for deposit on to the stack.

7 Claims, 2 Drawing Sheets

APPARATUS FOR STACKING SHEETS

BACKGROUND OF THE INVENTION

1. Field of the Invention

The invention relates to an apparatus for stacking sheets, for example for stacking banknotes in cassettes of automatic service machines.

2. Description of the Prior Art

A stacking apparatus is known from United Kingdom Patent Application No. GB 2 198 122 A in which a banknote or a bundle of notes is clamped for the purposes of deposit thereof between a stationary endless belt and a displaceable endless transportation belt of a transportation system which is arranged with its rollers on a carriage which is displaceable over a stack of banknotes. The banknote is firstly precisely oriented above the stack in a transportation direction and is separated from the stack by the transportation belt. A drive then displaces the carriage in the opposite direction to the direction of transportation of the banknote, while a variation in the belt geometry of the transportation system takes place in such a way that the banknote is deposited on the stack.

Another stacking apparatus is described in German utility model No. G 90 05 298 which deposits the sheets on the stack with a higher degree of precision by means of a simplified transportation system as separate protective belts hold down the stack so that the belts of the transportation system do not slide on the stack and displace the uppermost sheets thereof.

Testing devices of an optical or magnetic nature for detecting printed images on sheets are also known for example from European Patent Application No. EP 072 237 A2 or United Kingdom Patent Application No. GB 2 130 414 A.

OBJECT AND SUMMARY OF THE INVENTION

An object of the present invention is to provide a simple and inexpensive apparatus for the rapid stacking of sheets, which has a small moving mass and which provides for secure retention of the sheets which are deposited on the stack.

In accordance with the invention, there is provided an apparatus for stacking sheets in a stack, comprising a rail having first and second ends, a carriage mounted for movement along said rail, first and second outer guide rollers mounted on said carriage, a central guide roller mounted on said carriage between said first and second outer guide rollers, first and second direction changing rollers mounted adjacent said first and second ends of said rail, respectively, first and second belt anchorage means disposed adjacent said first and second ends of said rail, respectively, a first belt having first and second end portions extending from said first and second belt anchorage means, respectively, to said first and second outer guide rollers, respectively, and lying in a common top-of-stack plane defining a top of the stack, third and fourth portions extending from said first and second outer guide rollers, respectively, to said first and second direction changing rollers, respectively, and lying in a common transportation plane, and a fifth portion extending between said first and second direction changing rollers, first and second end rollers mounted adjacent said first and second direction changing rollers, respectively, a second endless belt supported by said first and second end rollers and having first and second portions overlying said third and fourth portions, respectively, of said first belt in said transportation plane, and a third portion between said first and second portions of said second belt which is depressed by said central guide roller towards said top-of-stack plane, and drive means for causing said carriage to move along said rail whereby a sheet disposed between said belts in said transportation plane is moved in said transportation plane towards said carriage and is rolled around a respective one of said outer guide rollers into said top-of-stack plane for deposit on a stack beneath the top-of stack plane.

Other objects, features and advantages of the present invention will become apparent upon consideration of the following detailed description of a preferred embodiment thereof, especially when considered with the accompanying drawings in which like reference numerals are employed to designate the same or similar components in the different figures.

DETAILED DESCRIPTION OF THE PREFERRED EMBODIMENT

Figure 1:
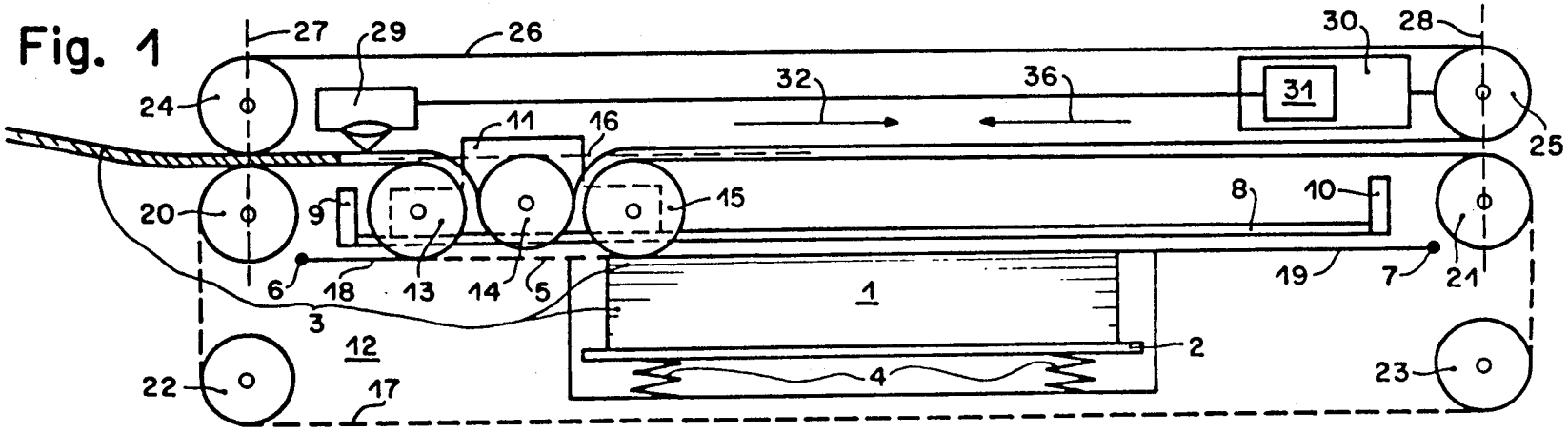
FIG. 1 is a schematic side view of a stacking apparatus.

In FIG. 1 reference numeral 1 identifies a stack of sheets, reference numeral 2 identifies a support plate and reference numeral 3 identifies sheets which are laid on the plate 2 and form the stack 1. For example the sheets 3 may be of different predetermined sizes such as banknotes consisting of a predetermined set of nominal values. Springs 4 act by way of the plate 2 to press the stack 1 upwardly to a top-of-stack plane 5 defined by fixed points 6 and 7 lying outside the stack 1.

Arranged above the top-of-stack plane 5 and parallel thereto is a rail 8 for a carriage 11 which is displaceable on the rail 8 between limit stops 9, 10. The limit stops 9, 10 are disposed outside the region of the stack 1. The carriage 11 carries three guide rollers 13, 14, 15 in mutually juxtaposed relationship. The top-of-stack plane 5 is tangential to lower portions of the two outer guide rollers 13, 15 and a transportation plane 16 which is parallel to the top-of-stack plane 5 is tangential to upper portions of the rollers 13,15. Also, both planes 5 and 16 and the axes of the rollers 13, 14, 15 are perpendicular to the plane 12 of the paper of FIG. 1.

A belt 17 of predetermined length is fixed by its two ends 18, 19 by belt anchorages at the fixed points 6 and 7. Each end 18, 19 is taut in the top-of-the-stack plane 5 between the respective fixed point 6, 7 and the adjacent outer guide roller 13, 15, respectively, and passes in a semicircle around the respective guide roller 13, 15 into the transportation plane 16 and extends in that plane beyond the fixed point 6, 7 respectively to a respective direction-changing roller 20, 21. The belt 17 connects the two ends 18, 19 by way of further direction-changing rollers 22, 23. In the drawing a part of the belt 17 which is between the rollers 20, 21 is shown in broken lines as that part of the belt 17 and the further direction-changing rollers 22, 23 may also be disposed outside the plane 12 of the paper.

Two end rollers 24, 25 and the central guide roller 14 tension an endless belt 26 which bears against the belt 17 in the transportation plane 16 in the regions between the end rollers 24, 25 and the respective adjacent outer guide rollers 13, 15. Between the two outer guide rollers 13, 15 the endless belt 26 is depressed by means of the central guide roller 14 out of the transportation plane 16 towards the top-of-stack plane 5, with a predetermined spacing being maintained relative to the plane 5.

The axes of the rollers 20, 21, 22, 23, 24, 25 are fixed. The axes of each direction-changing roller 20, 21 and its respective end roller 24, 25 define a respective intake plane 27, 28 which is perpendicular to the top-of-stack plane 5 and transportation plane 16. When the carriage 11 is moved between the limit stops 9, 10, the belts 17, 26 can engage a sheet 3 in the intake plane 27 or 28 and convey it, clamped between the belts 17, 26, towards the carriage 11 in the transportation plane 16.

In a modified embodiment of the transportation system, a plurality of side-by-side pairs of belts may be provided, wherein the mutually corresponding rollers 13, 14, 15, 20, 21, 24, 25 for each pair of belts are carried on common axes or shafts. Also, instead of belts 17, 26, it is also possible, in particular with regard to the belt 17, to use cords of circular cross-section.

A testing device 29 may be disposed in the transportation direction directly downstream of the intake plane 27. The testing device 29 senses the sheets 3 which are moved past it in the transportation plane 16 and outputs corresponding signals to a drive 30 with an associated control device 31. The drive 30 is coupled for example to one of the end rollers 24, 25 and sets the belts 17, 26 and the carriage 11 in motion.

The drive 30 may alternatively act directly on the carriage 11, for example with a drive cable, or may be disposed on the carriage 11, and in this case the belts 17, 26 are driven indirectly by the displacement of the carriage 11.

The control device 31 is connected to various sensors as for example to the testing device 29 and is designed to control the drive 30 in dependence upon signals from the sensors. If for example a sensing device in the first intake plane 27 detects the presence of the leading edge of the sheet 3 which is to be transported towards the carriage 11, the sensing device transmits a signal to the control device 31 which in turn switches on the drive 30. The drive 30 sets the endless belt 26 in motion in a counter-clockwise direction. Frictional forces in the transportation plane 16 transmit the movement of the endless belt 26 to the belt 17, in which case the carriage 11 which is waiting adjacent the first limit stop 9 is accelerated in a direction of movement 32 towards the second limit stop 10. The belts 17 and 26 convey the sheet 3 which is engaged in the intake plane 27 in the direction of movement 32 at double the speed of the carriage 11. When it reaches the first guide roller 13, the sheet 3 is deflected with its leading edge bearing snugly against the belt 17 through 180° out of the transportation plane 16 into the top-of-stack plane 5.

Figure 2:
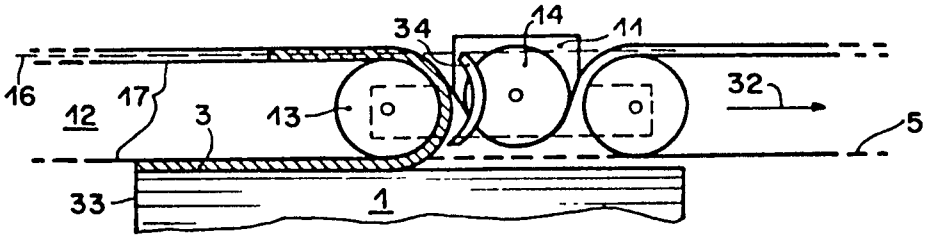
FIG. 2 is a side view of a carriage with a deflection device used in the apparatus of FIG. 1.

The first limit stop 9 on the rail 8 is positioned such that, as shown in FIG. 2, the leading edge of the sheet 3, after being turned around into the plane 5, is deposited flush with the edge 33 of the stack 1 which is nearest the first intake plane 27 (FIG. 1). Further movement of the carriage 11 in the same direction of movement 32 rolls the sheet 3 on to the stack 1 about the first outer guide roller 13, with the positions of the front and rear sides of the stack 3 being interchanged in the stacking procedure.

The carriage 11 advantageously comprises a deflection device 34 arranged directly above the top-of-stack plane 5, between the outer guide roller 13 and the central guide roller 14, at the position where the endless belt 26 lifts away from the belt 17 on the periphery of the outer guide roller 13. The deflection device 34 guides the sheet 3 in contact with the belt 17 out of the transportation plane 16 around the outer guide roller 13 and into the top-of-stack plane 5 and securely deflects even relatively stiff or very soft sheets 3 on to the stack 1 where they are deposited without folds in the predetermined position. Instead of individual sheets 3, it is also possible for a bundle of sheets 3 to be stacked in a stacking operation.

Figure 3:
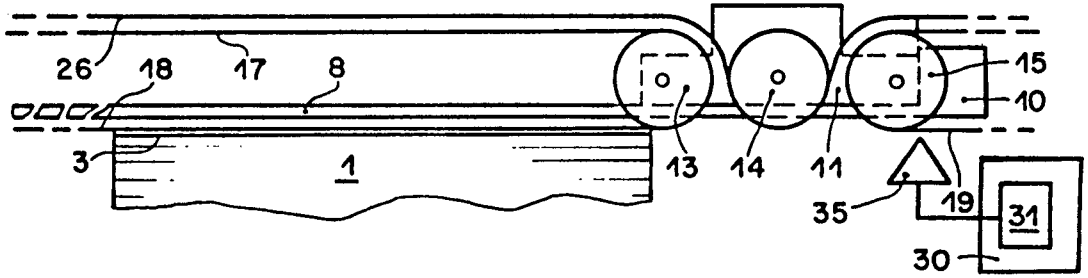
FIG. 3 shows the carriage of FIG. 2 in a limit position.

In FIG. 3 the carriage 11 has moved further along the rail to the second limit stop 10 and the sheet 3 is completely deposited on the stack 1. A sensor 35 connected to the control circuit 31 is arranged adjacent the second limit stop 10 for detecting the arrival of the carriage 11. In response to a signal from the sensor 35 the control circuit 31 switches over the drive 30 and the carriage 11 moves back to the first limit stop 9 (FIG. 1). A further sensor similar to the sensor 35 detects the arrival of the carriage 11 at the first limit stop 9 and causes the control device 31 to switch off the drive 30. The sensors may be for example in the form of light barriers or mechanically actuated switches.

The apparatus described above enjoys the advantages that only two belts 17, 26 are passed around the fixed axis rollers 20, 21, 22, 23, 24, 25 (FIG. 1), that the carriage 11 with the guide rollers 13, 14, 15 is displaceable on the rail 8 at high levels of acceleration by virtue of its very low inertia and that at least one of the belt ends 18, 19 is constantly pressed against the stack 1 without exerting any sideways force on the uppermost sheet 3 in the stack.

In FIG. 1, when the sheet 3 is drawn in, the testing device 29 scans the printed image thereon, for example optically or magnetically, and compares the scanned values to a set of stored reference values. After the recognition procedure has taken place, the testing device 29 outputs acceptance or rejection signals to the control device 31 by way of a signal line.

If the testing device 29 classifies the sheet 3 as unacceptable, the control device 31 advantageously switches over the drive 30 before the sheet 3 is completely deposited on the stack 1 as thus there is no need for an expensive operation of taking a sheet from the stack 1. By virtue of the carriage 1 being moved back to the first limit stop 9, the sheet 3 can be removed from the transportation plane 16 through the intake plane 27.

If the operation of detecting the printed image on the sheet takes a longer time than the time required for the central guide roller 14 to pass over the stack 1, a predetermined hold point is provided on the rail 8 above the stack 1, and the carriage 11 waits for the end of the sheet detection procedure at the hold point; in that situation the trailing end of the sheet 3 which is entirely scanned by the testing device 29 is still in the transportation plane 16 between the belts 17, 26 and it is possible for the sheet 3 to be returned in the event of its being rejected.

After the recognition procedure has taken place, the carriage 11 is set in motion again. If the sheet 3 is to be accepted and stacked, the testing device 29 outputs the acceptance signal to the control device 31 so that the carriage 11 moves further along in the same direction of movement 32 until the stacking operation is terminated. In the event of the sheet 3 being rejected, the rejection signal causes the drive 30 to be reversed. In response thereto the carriage 11 moves back to the first limit stop 9 in the opposite direction 36 to the direction of movement 32 and the sheet 3 is removed from the apparatus.

Instead of the expensive operation of recognition of the printed image on the sheet 3, the testing device 29 in a simpler construction may be in the form of a light barrier assembly which, in conjunction with the control device 31, measures the length of the sheets 3. The drive 30 is preferably provided with a stepping motor, in which case the switching device 31, by reference to the number of steps of the drive 30 while the light barrier assembly is masked, calculates the sheet length and compares it to predetermined reference values. In this case, the endless belt 26 and the driven end roller 24 or 25 are advantageously toothed so as to eliminate any slippage error.

The apparatus can easily be constructed and operated in a symmetrical manner with regard to sheet transportation, with a set of sensors being disposed along the rail 8 for each direction of movement 32 and 36. Both in one direction of movement 32 and also in the opposite direction of movement 36, the sheet 3 which is fed to the transportation plane 16 through the intake plane 27 or 28 respectively can be engaged by the belts 17, 26 and deposited on the stack 1. In this case, the sheet 3 in the transportation plane 16 and the carriage 11 may always be moved in the same direction of movement 32 or 36 for the stacking operation. Alternatively, feeding the sheets 3 through both intake planes 27 and 28 advantageously shortens the stacking operation as the unproductive return of the carriage 11 to the first limit stop 9 is eliminated.

The holding locations for the carriage 11 along the rail 8 are established for example by means of sensors which are disposed at predetermined locations. The output signals of the sensors act on the control device 31 and permit the carriage to go accurately to predetermined locations. The positions of the sensors may be arranged displaceably along the rail 8, for example by adjusting means, so as to enable adjustment of the hold locations. If the drive 30 is provided by the stepping motor, the holding locations can also be established by counting the stepping movements.

Figure 4:
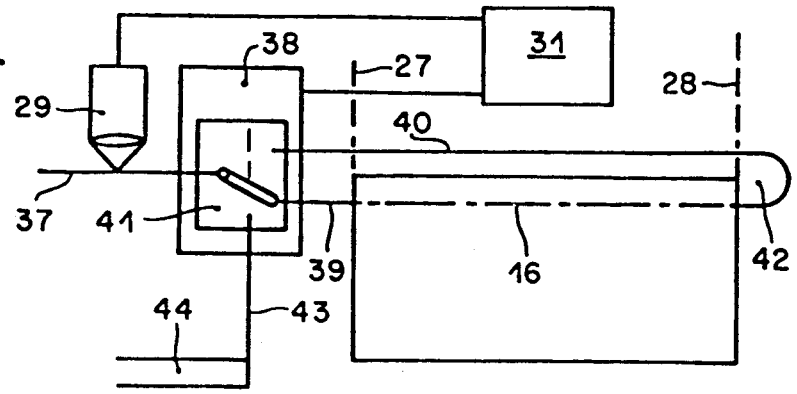
FIG. 4 is a schematic side view of the sheet stacking apparatus of FIG. 1 in combination with a sheet turning apparatus.

In FIG. 4, a feed section 37 which is arranged upstream of the intake plane 27 advantageously has a branching arrangement 38 which adjoins the feed section 37 and the branches 39 and 40 of which lead to the transportation plane 16 for feeding the sheets 3 (FIG. 1) through either of the two intake planes 27 and 28. The branching arrangement 38 has a sheet passage 41 which can be switched over in a predetermined fashion between the branches 39 and 40 and which passes the sheet 3 supplied by the feed section 37 by way of the selected branch 39 or 40 into the transportation plane 16.

The control device 31 is arranged to produce control signals for the branching arrangement 38, which are transmitted to the branching arrangement 38 by a line connection and which determine the position of the sheet passage 41. The control device 31 for example switches over the sheet passage 41 after each sheet 3 so as to provide an efficient stacking operation whereby the individual sheets 3 are fed alternately to one branch 39 and the other 40.

The testing device 29 may be disposed at the feed section 37 in order to scan the sheet 3 which is transported on the feed section 37 to the branching arrangement 38 and to compare the scanned values to the stored predetermined set of reference values, the sheet 3 being recognised on the basis of the printed image on both the front side and the rear side thereof. If the acceptance signal is supplemented by information concerning the recognised side of the sheet 3, the control device 31 may be arranged to produce the control signal for the branching arrangement 38 such that the sheet passage 41 is set to the branch 39 or 40 in dependence on the recognised side of the sheet 3. Thus, the apparatus advantageously deposits all sheets 3 on the stack 1 in an orderly arrangement (see FIG. 1), with the sheets 3 having the same side facing towards the plate 2 (see FIG. 1). For example all sheets 3 which the testing device 29 recognises on the basis of the printed image on the front side are passed into the transportation plane 16 by way of the branch 39 through the intake plane 27. The other accepted sheets 3 pass by way of the branch 40 with a 180° deflection as indicated at 42 through the intake plane 28 into the transportation plane 16.

Rejected sheets 3 can be returned to a reject compartment 44 by way of a reject branch 43 of the branching arrangement 38.

Figure 5:
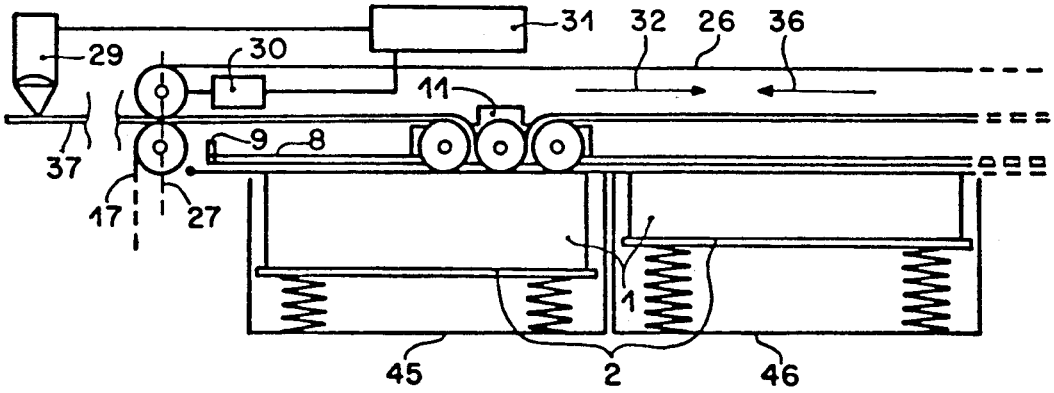
FIG. 5 shows the stacking apparatus of FIG. 1 in the form of a sheet sorter.

In FIG. 5, the apparatus has a plurality of stacks 1, two of which are shown, which are arranged in succession in the direction of movement 32 beneath the top-of-stack plane 5. Each stack 1 is stacked on its own support plate 2 and can be pulled out from under the top-of-stack plane 5 by means of a respective cassette 45, 46 in order for the filled cassette 45, 46 to be replaced by an empty one. For example each stack 1 comprises banknotes of a respective nominal value, with the number of stacks to be arranged in succession beneath the rail 8 being determined by the number of nominal values to be stacked.

Between the limit stops 9 and 10 (see FIG. 1) the rail 8 advantageously has predetermined starting positions for the carriage 11 for each stack 1 and for both the directions of movement 32, 36 of the carriage 11, so that the apparatus can transport the sheets 3 to the appropriate stacks 1, according to the properties of the sheets. On the feed section 37 the testing device 29 analyses the sheet 3 (FIG. 1) and passes to the control device 31 a stacking signal which corresponds to the printed image on or the size of the sheet 3. The control device 31 is designed to receive the stacking signal and to control the drive 30 in dependence on the stacking signals. Before the sheet 3 reaches the intake plane 27 or 28 respectively, the drive 30 moves the carriage 11 to the required starting position so that the sheet 3 is deposited on the appropriate stack 1 after being engaged by the belts 17, 26.

Figure 6:
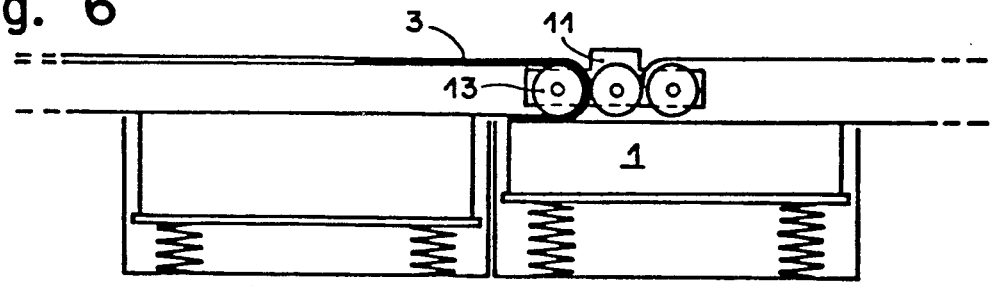
FIG. 6 shows the sheet sorter of FIG. 5 part-way through a stacking operation.

The carriage 11 is moved into a starting position above one of the stacks 1 and there awaits the arrival, in the intake plane 27, of the sheet 3 which is to be deposited on another stack 1. As soon as the sensor in the intake plane 27 detects the leading edge of the sheet 3, the carriage 11 accelerates in the direction of movement 32. In FIG. 6 the sheet 3 which is engaged by the belts 17, 26 has caught up the carriage 11 and is deposited on the second stack, after being reversed around the guide roller 13.

Figure 7:
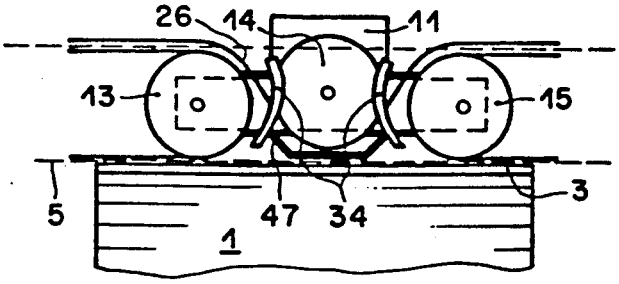
FIG. 7 is a side view of the carriage of the apparatus of FIG. 4.

In order that the sheets 3 can be stacked without difficulty from either intake plane 27, 28, both guide rollers 13, 15 may have the deflection devices 34, as shown in FIG. 7. Also, a protective plate 47 which is arranged between the two deflection devices 34 immediately above the stack plane 5 on the carriage 11 advantageously prevents contact of the endless belt 26 which is passed over the central guide roller 14, with the uppermost sheet 3 of the stack 1. The protective plate 47 is bent away from the top-of-stack plane 5 on the sides which are towards the outer guide rollers 13, 15 so that sheets 3 cannot become caught on the protective plate 47. Its curvature may be uniform, in which case the protective plate 47 follows the endless belt 26 which passes around the central guide roller 14, at a predetermined spacing therefrom, between the deflection devices 34. The protective plate 47 and the deflection devices 34 may be connected together and form a unit.

Having described a preferred embodiment of the invention with reference to the accompanying drawings, it is to be understood that the invention is not limited to the precise embodiment and that various changes and modification thereof may be effected by one skilled in the art without departing from the spirit or scope of the invention as defined in the appended claims.

What is claimed is:

1. An apparatus for stacking sheets in a stack, comprising:

a rail having first and second ends;

a carriage mounted for movement along said rail;

first and second outer guide rollers mounted on said carriage;

a central guide roller mounted on said carriage between said first and second outer guide rollers;

first and second direction changing rollers mounted adjacent said first and second ends of said rail, respectively;

first and second belt anchorage means disposed adjacent said first and second ends of said rail, respectively;

a first belt having first and second end portions extending from said first and second belt anchorage means, respectively, to said first and second outer guide rollers, respectively, and lying in a common top-of-stack plane defining a top of the stack, third and fourth portions extending from said first and second outer guide rollers, respectively, to said first and second direction changing rollers, respectively, and lying in a common transportation plane, and a fifth portion extending between said first and second direction changing rollers;

first and second end rollers mounted adjacent said first and second direction changing rollers, respectively;

a second endless belt supported by said first and second end rollers and having first and second portions overlying said third and fourth portions, respectively, of said first belt in said transportation plane, and a third portion between said first and second portions of said second belt which is depressed by said central guide roller towards said top-of-stack plane; and drive means for causing said carriage to move along said rail whereby a sheet disposed between said belts in said transportation plane is moved in said transportation plane towards said carriage and is rolled around a respective one of said outer guide rollers into said top-of-stack plane for deposit on a stack beneath the top-of stack plane.

2. An apparatus as set forth in claim 1, further comprising a deflection device mounted on said carriage between one of said outer guide rollers and the central guide roller for guiding a sheet in contact with said first belt around the respective outer guide roller into said top-of-stack plane.

3. Apparatus as set forth in claim 1, further comprising a protective plate mounted on said carriage between said second belt on said central guide roller and said top-of-stack plane.

4. Apparatus as set forth in claim 1, wherein said first direction changing roller and said first end roller define a first sheet intake, and said second direction changing roller and said second end roller define a second sheet intake, and further comprising a sheet branching device operable to feed a sheet selectably to said first sheet intake and said second sheet intake.

5. Apparatus as set forth in claim 4, further comprising recognition means disposed adjacent the said branching device for recognizing printed images on the sheets and providing a signal, and control means for controlling said drive means to move said carriage and for controlling said branching device to select the sheet intake in dependence on said signal.

6. Apparatus as set forth in claim 1, further comprising recognition means for testing a sheet in said transportation plane and providing a signal, and control means responsive to said signal for controlling said drive means, whereby, before said sheet is completely deposited on said stack, said carriage is stopped at a predetermined holding location until testing of said sheet by said recognition means has taken place, and thereafter said carriage is set in motion again in a direction of movement which is dependent on said signal.

7. Apparatus as set forth in claim 1, wherein said rail extends over at least two stacks and, upon engagement of a sheet by said belts, said carriage has a starting position on said rail determined in accordance with that one of said stacks on which said sheet is to be deposited.

* * * * *